US007191728B2

(12) United States Patent
Eck

(10) Patent No.: US 7,191,728 B2
(45) Date of Patent: Mar. 20, 2007

(54) ATTACHMENT SYSTEM FOR WATERCRAFT ACCESSORIES

(75) Inventor: Richard E. Eck, Minneapolis, MN (US)

(73) Assignee: BRP US Inc., Sturtevant, WI (US)

( * ) Notice: Subject to any disclaimer, the term of this patent is extended or adjusted under 35 U.S.C. 154(b) by 0 days.

(21) Appl. No.: 10/879,498

(22) Filed: Jun. 30, 2004

(65) Prior Publication Data

US 2006/0000406 A1 Jan. 5, 2006

(51) Int. Cl.
*B63B 17/00* (2006.01)

(52) U.S. Cl. ..... 114/364

(58) Field of Classification Search ..... 114/364

See application file for complete search history.

(56) References Cited

U.S. PATENT DOCUMENTS

| | | | | |
|---|---|---|---|---|
| 3,367,349 | A * | 2/1968 | O'Link | 114/361 |
| 4,673,119 | A * | 6/1987 | Bott | 224/326 |
| 5,413,063 | A * | 5/1995 | King | 114/221 R |
| D465,194 | S | 11/2002 | Eck | |
| 6,978,731 | B2 * | 12/2005 | Erbetta | 114/361 |

* cited by examiner

*Primary Examiner*—Jesús D. Sotelo
(74) *Attorney, Agent, or Firm*—Osler, Hoskin & Harcourt LLP

(57) ABSTRACT

A kit for connecting a watercraft accessory to a watercraft, comprising: a rail portion. Two connectors each are adapted to be secured to the watercraft. The connectors each have a rail connector portion for receiving respective ends of the rail portion to connect the rail portion to the watercraft. A first connector portion is provided for receiving a watercraft accessory portion to connect the watercraft accessory to one of the two connectors or the rail portion.

16 Claims, 7 Drawing Sheets

ATTACHMENT SYSTEM FOR WATERCRAFT ACCESSORIES

FIELD OF THE INVENTION

The present invention generally relates to watercraft and, more particularly, to an attachment system for connecting accessories to the watercraft.

BACKGROUND OF THE INVENTION

In the nautical industry, a variety of accessories and accessories are available for watercraft. Such accessories can be added to the watercraft in conjunction with additional uses or for providing additional functionality. As an example of an additional use, the watercraft may be equipped with a watersport tower for the watercraft to be used to tow a wakeboard. As for additional functionality, a top can be mounted to the watercraft to provide shade for the passengers of the watercraft. Also, a watercraft may be provided with an additional wind deflector to reduce the wind exposure of the passengers in the watercraft.

The above described accessories are typically secured directly onto the deck of the watercraft, often by drilling permanent holes in the deck. In instances when the watercraft is thereafter used without the optional accessories, the holes are left exposed. These holes have an effect on the aesthetics of the watercraft, an may therefore reduce the interest of consumers in watercraft accessories and accessories. Moreover, there is a risk that water enters through these holes and pools in the inner cavity of the watercraft. Rubber plugs or fiberglass putty have been used to temporarily or permanently block these holes, but these solutions also have an impact on the aesthetics of the watercraft.

Utility rails have been used to connect accessories to watercraft. The utility rails are typically found on the periphery of the deck of a watercraft. Such utility rails are laid directly onto the deck of the watercraft, and have an upper face that is used to connect watercraft accessories to the watercraft.

SUMMARY OF INVENTION

It is an aim of an aspect of the present invention to provide an attachment system for watercraft accessories that does not leave exposed holes in the watercraft when the watercraft accessories are not being used.

It is a further aim of an aspect of the present invention that the attachment system for watercraft accessories enables a plurality of watercraft accessories to be simultaneously connected to the watercraft. Therefore, in accordance with the present invention, there is provided a watercraft comprising: a first rail portion connected to a surface of the watercraft; and at least a first rail connector portion connecting the first rail to the watercraft, the first rail connector portion being adapted to be connected to a watercraft accessory, such that the watercraft accessory is connected to the watercraft.

Further in accordance with the present invention, there is provided a connector for connecting a rail portion to a watercraft, comprising: a connection surface for being secured to a surface of the watercraft; a rail connector portion for receiving an end of the rail portion to connect the rail portion to the watercraft; and a first connector portion for receiving a watercraft accessory portion to connect the watercraft accessory to the watercraft.

Still further in accordance with the present invention, there is provided a kit for connecting a watercraft accessory to a watercraft, comprising: a rail portion; two connectors each adapted to be secured to the watercraft, the connectors each having a rail connector portion for receiving respective ends of the rail portion to connect the rail portion to the watercraft; and at least a first connector portion for receiving a watercraft accessory portion to connect the watercraft accessory to any one of the two connectors and the rail portion.

BRIEF DESCRIPTION OF THE DRAWINGS

Having thus generally described the nature of the invention, reference will now be made to the accompanying drawings, showing by way of illustration a preferred embodiment thereof and in which.

DESCRIPTION OF THE PREFERRED EMBODIMENTS

Figure 1:
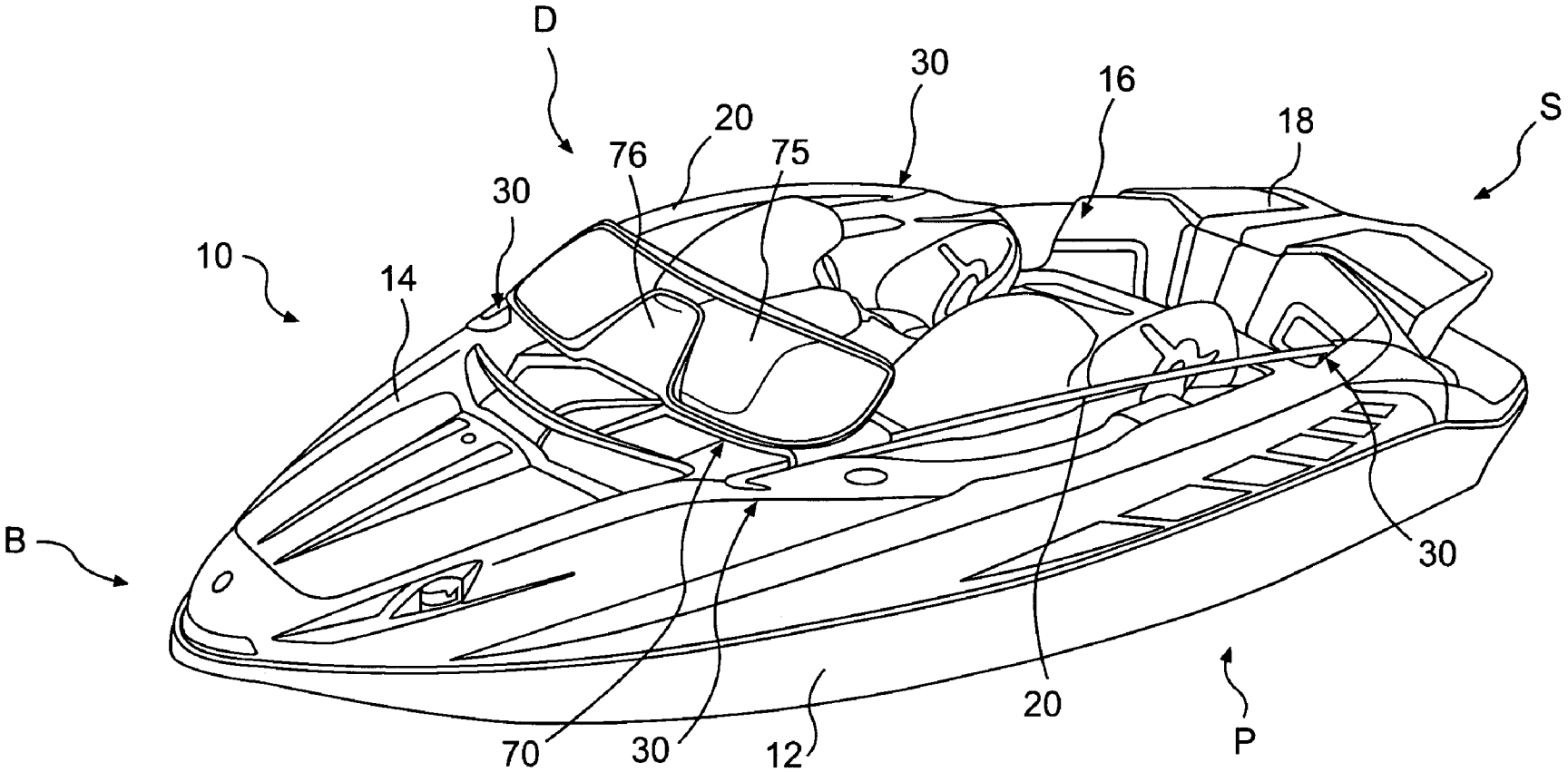
FIG. 1 is a perspective view of a watercraft having an attachment system and a wind deflector constructed in accordance with a preferred embodiment of the present invention.

Referring to the drawings, and more particularly to FIG. 1, a watercraft having an attachment system constructed in accordance with a preferred embodiment of the present invention is generally shown at 10. The watercraft 10 has a bow B, a stern S, a port side P and a starboard side D. The watercraft 10 has two main parts, namely a hull 12 defining an underside of the watercraft 10, and a deck 14. The hull 12 buoyantly supports the watercraft 10 on the water. The deck 14 has a recessed passenger area 16 designed to accommodate passengers. An engine cover 18 is positioned between the passenger area 16 and the stern S of the watercraft 10. The watercraft 10 is of conventional construction, the details of which are unimportant to the current invention.

The watercraft 10 has handrails 20 port and starboard of the passenger area 16. The handrails 20 are typically provided for facilitating displacements of passengers in the watercraft 10. The handrails 20 have handrail connectors 30 at ends thereof by which they are connected to the deck 14.

The handrails 20 differ from the conventional utility rails, which cannot ergonomically serve as handrails by their configuration. The handrails 20 are spaced from the deck 14, and may hence be used as support by passengers of the watercraft 10.

Figure 2A:
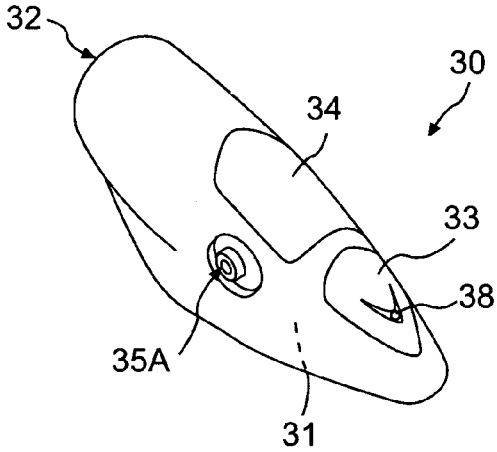
FIG. 2A is a perspective view of a handrail connector, constructed in accordance with the present invention, with connector portions thereof being hidden.

Referring to FIG. 2A, one of the handrail connectors 30 is shown having a body with a bottom surface 31. The bottom surface 31 is the interface between the handrail connector 30 and the deck (or any like surface) of the watercraft. A resilient pad may be sandwiched between the bottom surface 31 and the deck to reduce vibrations sustained by the handrail connectors 30. The handrail connectors 30 are preferably fastened to the deck 14 (FIG. 1) before the deck 14 is bonded to the hull 12 (FIG. 1), such that the fasteners are not visible once the hull 12 and the deck 14 are assembled. Alternatively, the handrails 20 and handrail connectors 30 may be an add-on feature available as a kit, in which case fasteners securing the handrail connectors 30 to the deck 14 would be visible.

Figure 3:
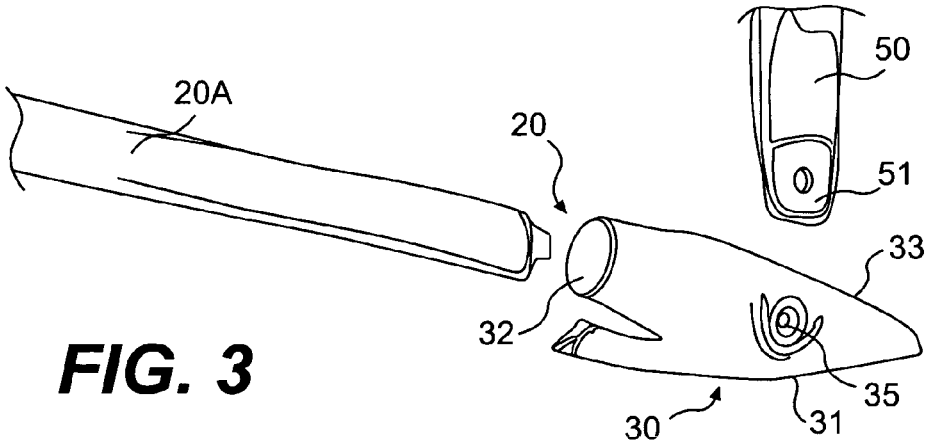
FIG. 3 is an exploded view of the handrail connector with a handrail and an accessory being connectable to the second connector portion.

The handrail connector 30 has a handrail connector portion 32, which is best seen in FIG. 3. In FIG. 3, a rail portion 20A of the handrail 20 is shown having a cylindrical connector end that is received in the handrail connector portion 32, defining a tubular portion of appropriate cross-sectional shape. The rail portion 20A is preferably welded to the handrail connector 30, or cast therewith. Alternatively, various fasteners, such as set screws, an adhesive, and the like can be used to fix the rail portion 20A to the handrail connector 30.

Referring to FIG. 2A, the handrail connector 30 has a first removable cap 33 and a second removable cap 34. The caps 33 and 34 are shaped such that the handrail connector 30 defines a smooth and generally continuous outer surface. Bores 35 (which are visible in FIG. 2C) are positioned adjacent to the second cap 34 and on opposed sides of the handrail connector 30, for receiving a fastener 35A that will secure the second cap 34 to the handrail connector 30.

Figure 2B:
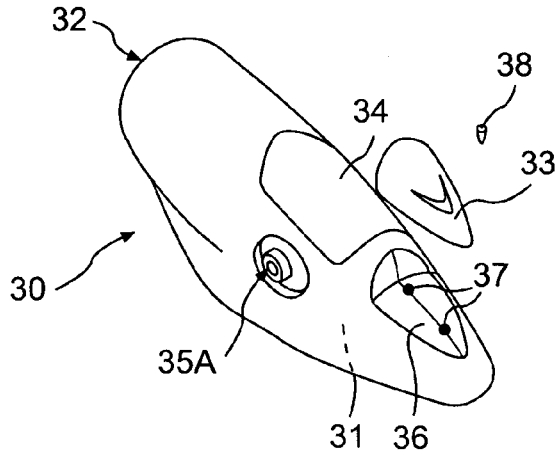
FIG. 2B is an exploded view of the handrail connector, showing a first connector portion thereof.

Referring to FIG. 2B, the first removable cap 33 is shown removed from the remainder of the handrail connector 30, thereby exposing the first connector portion. The first connector portion has a surface 36, preferably flat, with a pair of tapped bores 37. The tapped bores 37 are used for connecting accessories thereon, such as legs of a top structure, while the surface 36 is used as a support surface for supporting the accessories thereon. One of the tapped bores 37 can also be used, in combination with at least one screw 38 or other suitable fastener, to maintain the first removable cap 33 on the handrail connector 30, when the first connector portion is not in use.

Figure 2C:
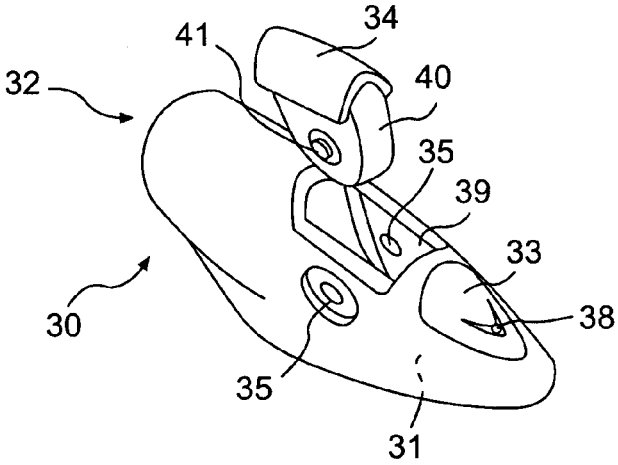
FIG. 2C is an exploded view of the handrail connector, showing a second connector portion thereof.

Referring to FIG. 2C, the second removable cap 34 is shown removed from the remainder of the handrail connector 30, thereby exposing the second connector portion. The second connector portion is defined by a cavity 39 in the body of the handrail connector 30. The bores 35 emerge into the cavity 39, and are axially aligned with one another. The cap 34 has a tab 40 that is received in the cavity 39. The tab 40 has an eyelet 41 that is aligned with the bores 35 when the second removable cap 34 is connected to the handrail connector 30. A suitable fastener, such as a screw or bolt, can be used to secure the cap 34 to the remainder of the handrail connector 30.

Referring to FIG. 3, the handrail connector 30 is shown with the second connector portion thereof exposed, ready for supporting a leg 50 of a watersport tower. The leg 50 has a tab 51 similar in shape to the tab 40 (FIG. 2C) of the handrail connector 30. A suitable fastener, for instance the fastener 35A that is used to secure the second removable cap 34 to the handrail connector 30, can also used to removably fix the leg 50 to the handrail connector 30.

Figure 4:
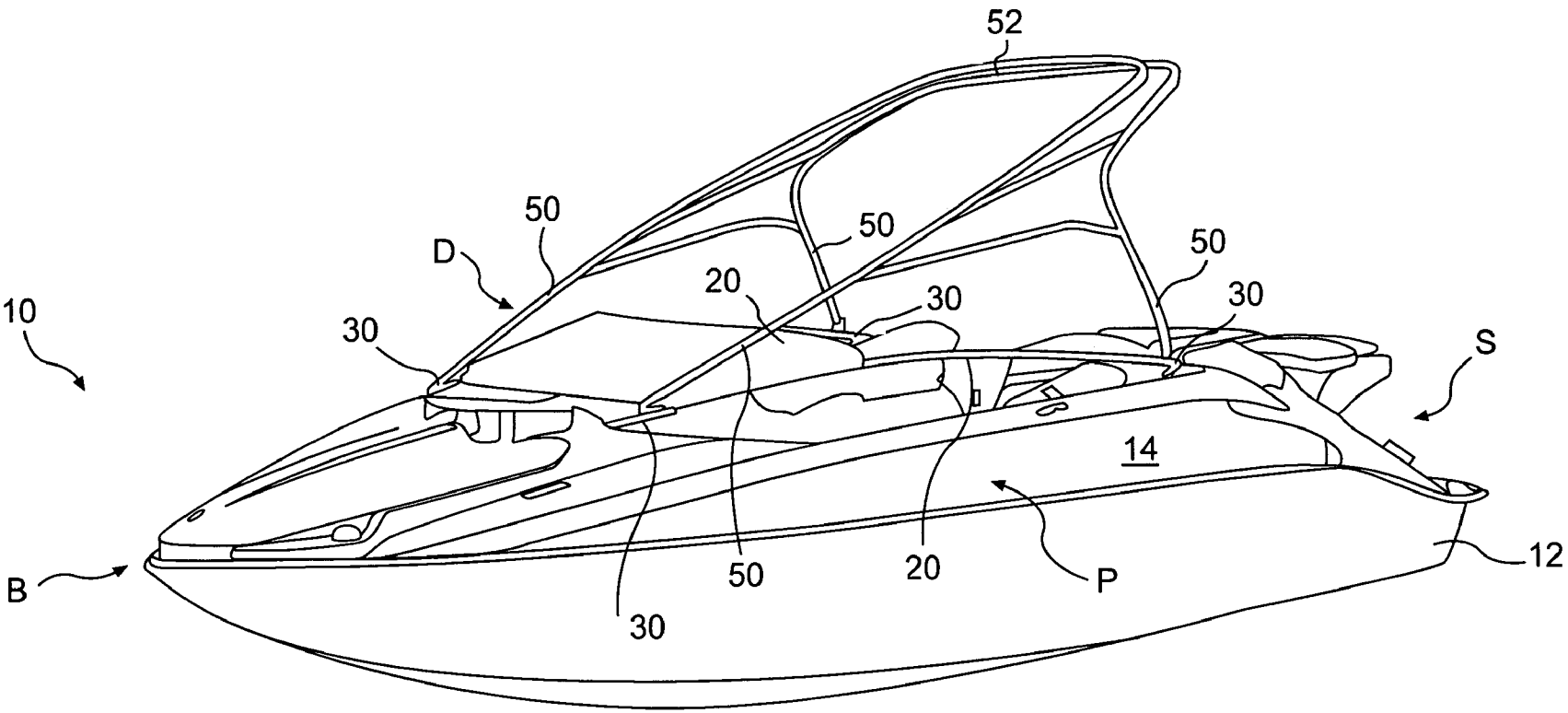
FIG. 4 is a perspective view of a watercraft having a watersport tower being connected to the watercraft through four of the handrail connector.

Referring to FIG. 4, a watersport tower 52 is shown secured to the watercraft 10 by having its four legs 50 each received in respective handrail connectors 30. It is pointed out that the first connector portions of the handrail connectors 30 are not used for the connection of the watersport tower 52 to the watercraft 10. It is hence contemplated to provide a handrail connector with only one of the first connector portion and the second connector portion.

Figure 5:
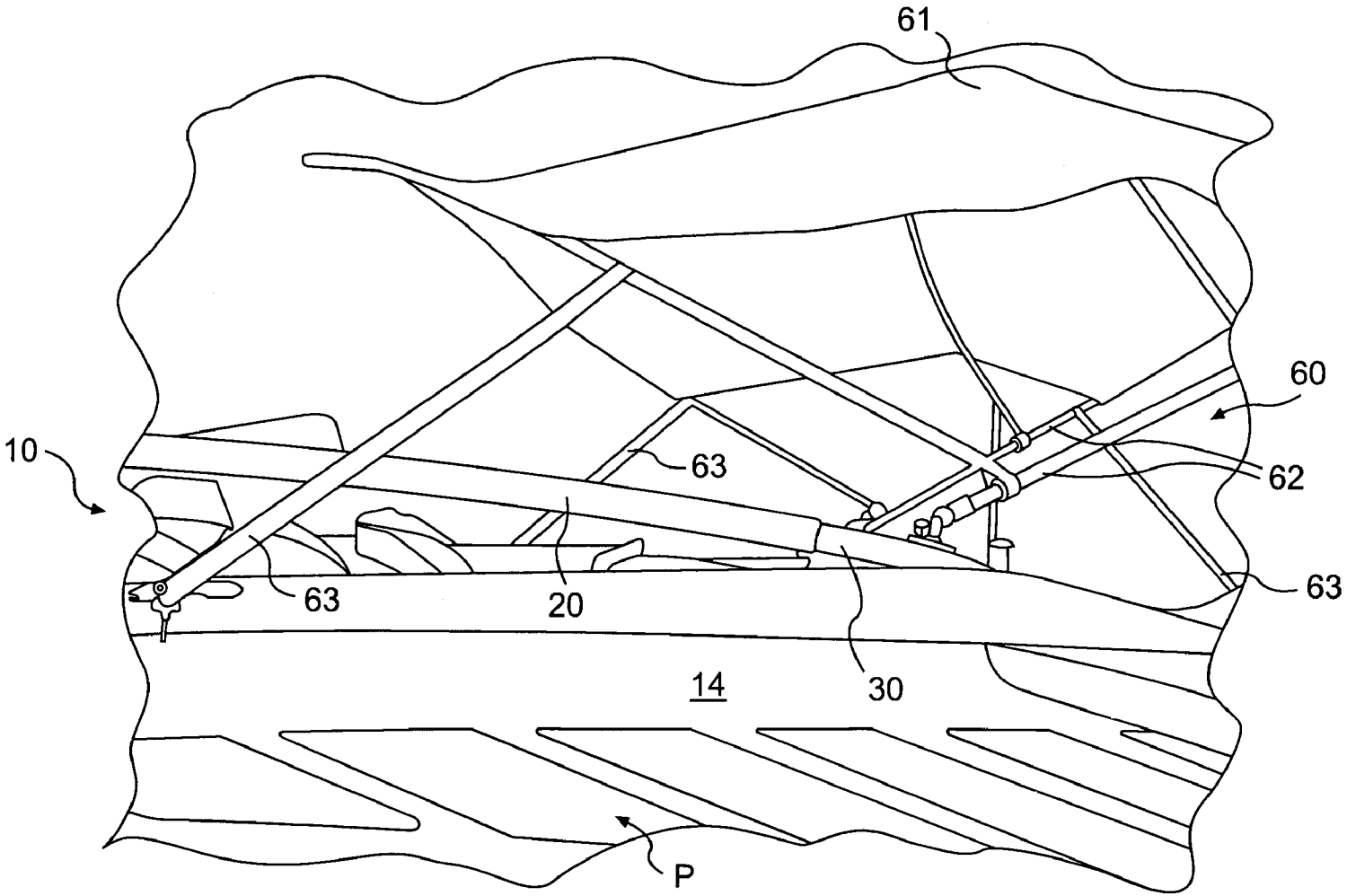
FIG. 5 is a perspective view of a watercraft having a top being connected to the watercraft through two of the handrail connector.

Referring to FIG. 5, one of the handrail connectors 30, positioned at the stern end of one of the handrails 20, is used to support a leg 62 of a top structure 60 having a top 61. The top structure 60 has a pair of legs 62 each connected to the first connector portion of a respective handrail connector 30. Tensors 63 of the top structure 60 are connected between the top structure 60 and the deck 14 to maintain the top 61 in a taut condition.

Figure 6:
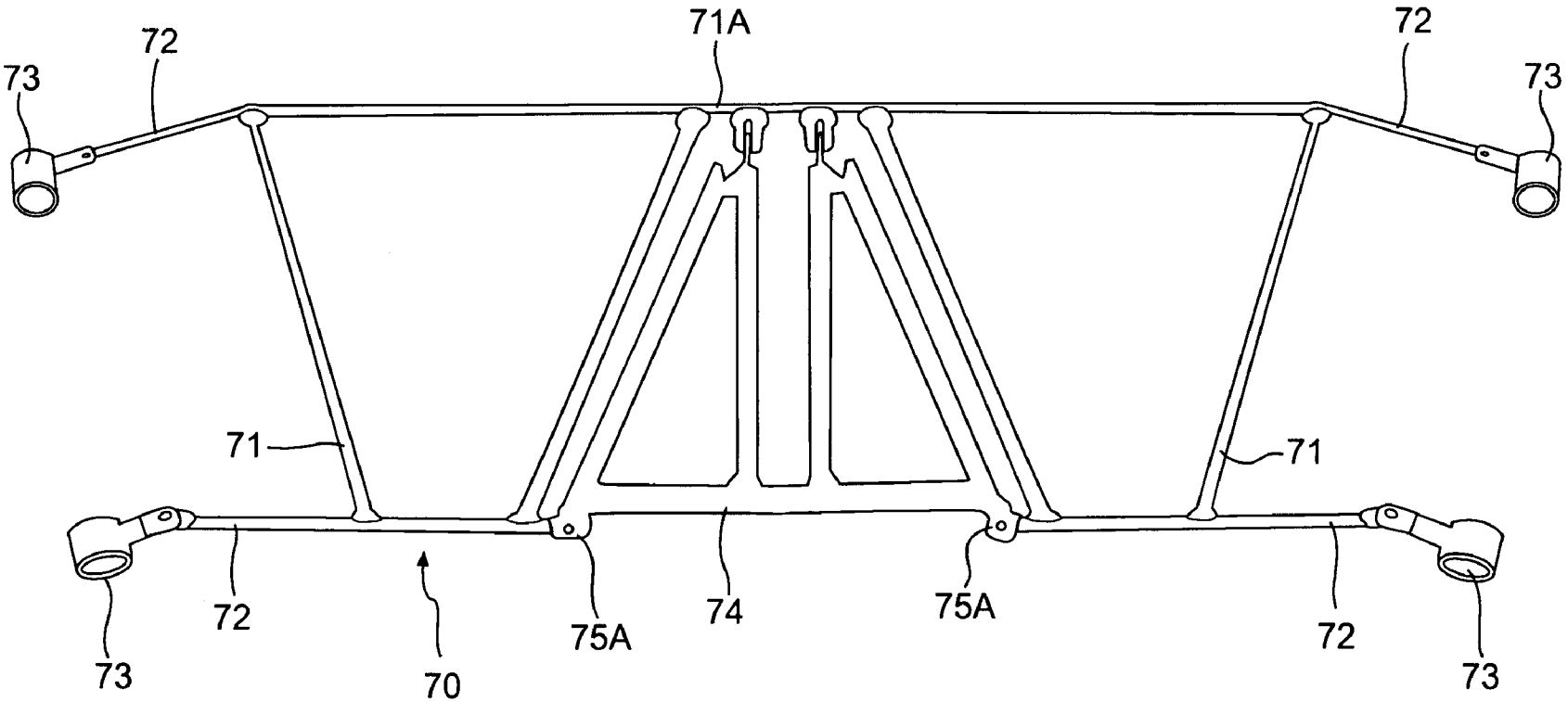
FIG. 6 is a top plan view of a wind deflector structure according to another aspect of the present invention.
Figure 7:
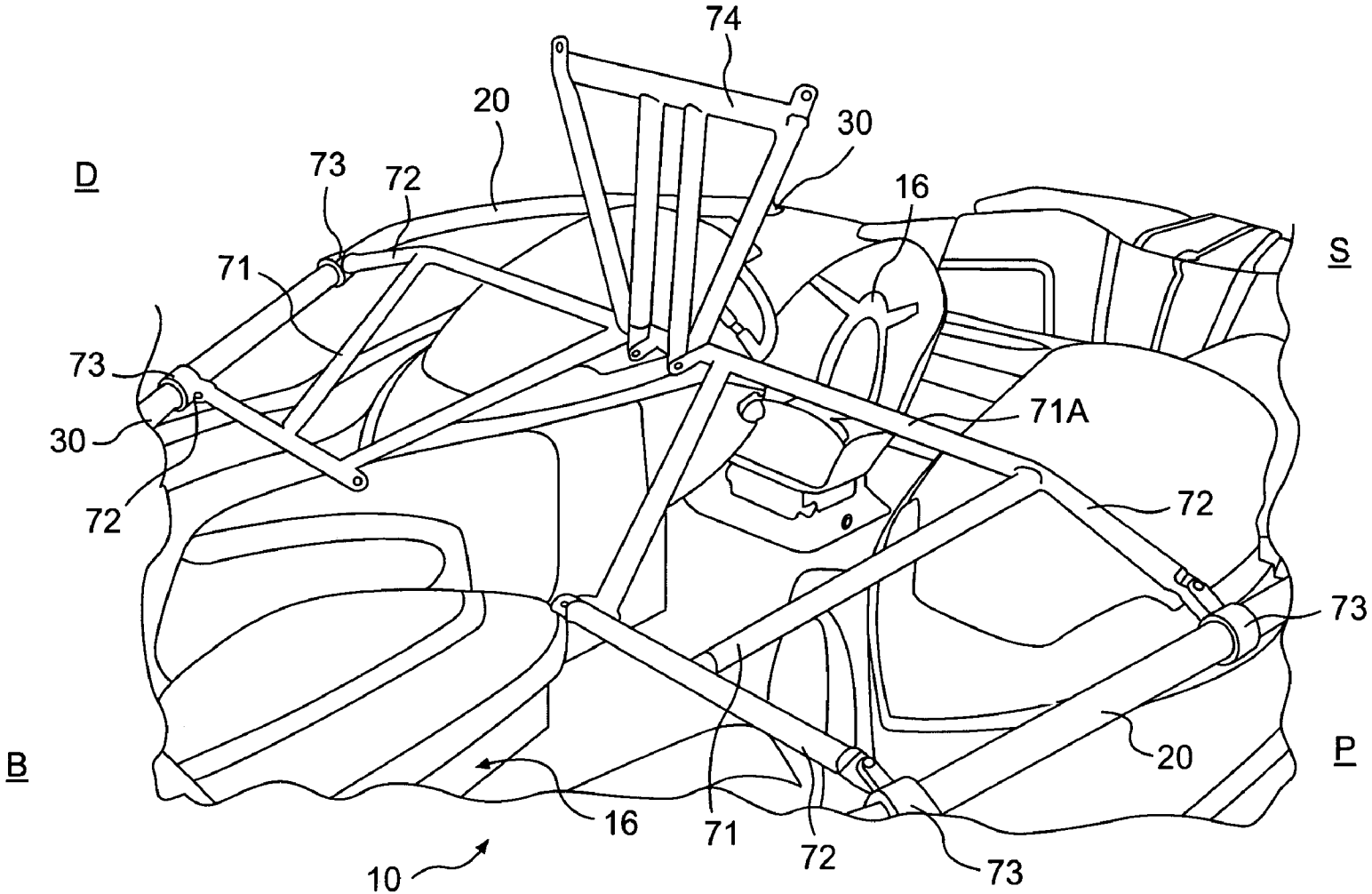
FIG. 7 is a perspective view of the wind deflector structure of FIG. 6 being connected to handrails of a watercraft.

In FIGS. 6 and 7, a wind deflector structure in accordance with an aspect of the present invention is generally shown at 70, but without wind deflecting panels thereon, to better illustrate the functionality of the wind deflector. Referring to FIG. 6, the wind deflector structure 70 has tubes (e.g., aluminum tubes) welded to one another to form a pair of trapezoid substructures 71. The trapezoid substructures 71 are interconnected by a tube 71A, which also defines an edge of both the trapezoid substructures 71. Pairs of arms 72 extend laterally from each of the trapezoid substructures 71. The arms 72 each have an end sleeve 73, to which the wind deflector structure 70 is connectable to the handrails 20.

A substructure 74, having a trapezoid outline, is inverted with respect to the trapezoid substructures 71, and is complementarily positioned between the pair of trapezoid substructures 71. An upper end of the substructure 74 is pivotally mounted to a portion of the tube 71A separating the trapezoid substructures 71, such that the substructure 74 is pivotable with respect to a remainder of the wind deflector structure 70. Bottom corners 75 of the substructure 74 each have an eyelet superposed with a corresponding eyelet of adjacent corners of the trapezoid substructures 71. The eyelets are used to fasten (e.g., by screws, bolts and nuts, or the like) the substructure 74 to a remainder of the wind deflector structure 70 in the position illustrated in FIG. 6. Alternatively, a slide bolt could be used to secure the substructure 74 to the remainder of the structure 70. Also, a resilient pad is preferably provided between the corners 75 of the substructure 74 and the receiving corners of the trapezoid substructures 71 to reduce vibrations and absorb noise.

Referring to FIG. 7, the wind deflector structure 70 is shown mounted to the handrails 20. More specifically, the end sleeves 73 are placed around the handrails 20, and are slidable thereon. The wind deflector structure 70 is positioned forward of the driver position of the watercraft 10, but partially rearward of a portion of the recessed passenger area 16. The substructure 74 is shown pivoted in order to provide access to this portion of the recessed passenger area 16.

Referring to FIG. 1, the wind deflector structure 70 is shown having wind deflecting panels 75 and 76 (e.g., tinted polycarbonate sheets). The wind deflecting panel 75 generally covers the trapezoid substructures 71, whereas the wind deflecting panel 76 covers the substructure 74. It is appreciated that the wind deflector panels 75 and 76 are separated from one another to allow the pivoting of the substructure 74.

Referring to FIG. 4, an alternative to the wind deflector structure 70 is illustrated. A wind deflector 70' is shown mounted to the handrails 20 of the watercraft 10. The wind deflector 70 does not have a pivoting substructure 74, and does not define a passage for passengers. It is pointed out that in the embodiments of FIGS. 1 and 4, the wind deflector is preferably low enough to allow a driver to see. Alternatively, the panels of the wind deflector may be substantially transparent to allow the driver to see therethrough.

Figure 8:
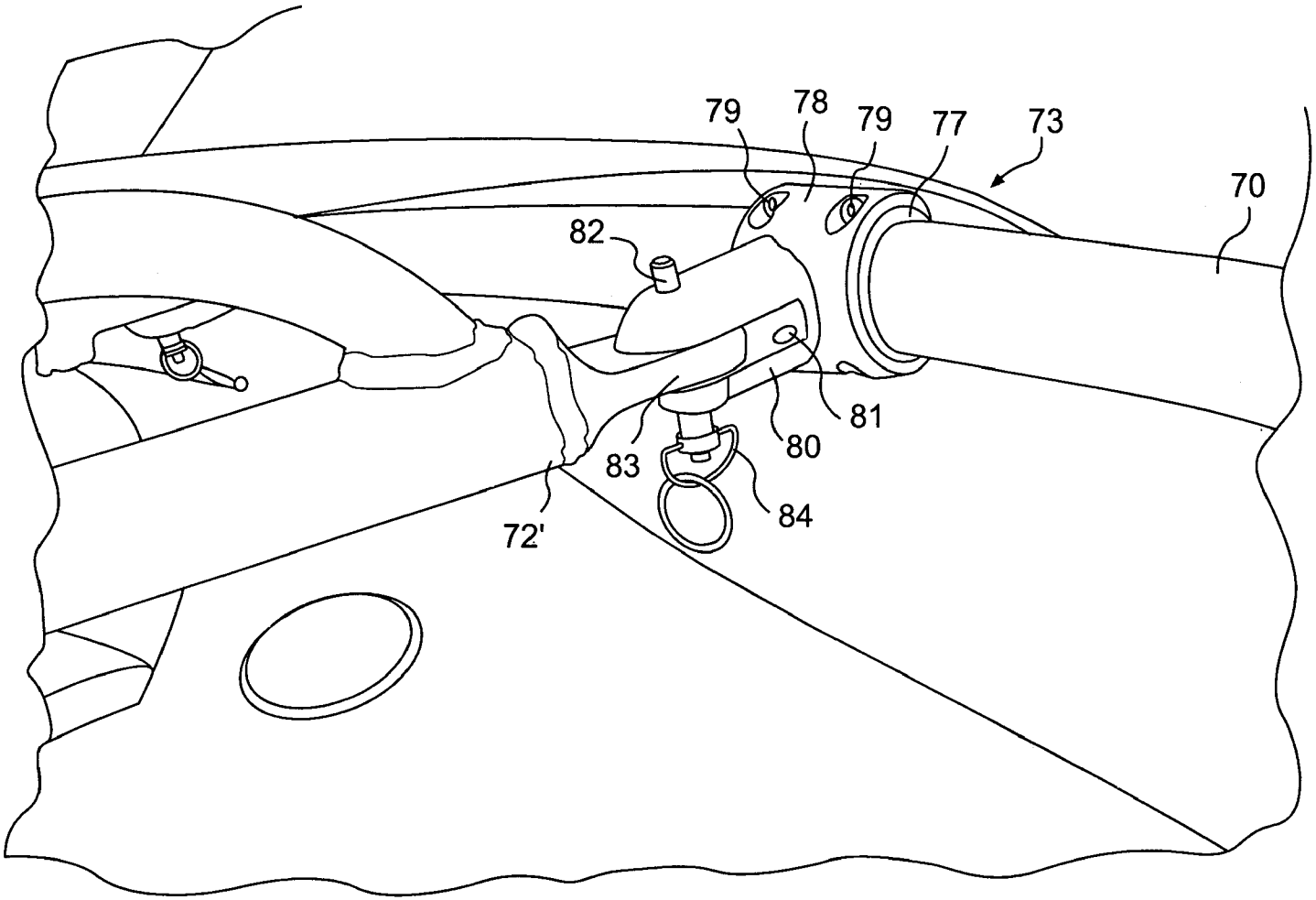
FIG. 8 is an enlarged perspective view of a connector end of the wind deflector structure, in accordance with another aspect of the present invention.

Referring to FIG. 8, one of the end sleeves 73 is shown having longitudinally separable halves 77 and 78 (forming a pair of C-brackets), to allow installation of the wind deflector structure 70 onto the handrails 20. Set screws 79 hold the halves 77 and 78 to one another.

According to another aspect of the present invention, the half 78 has a tab 80 protruding radially therefrom. The tab 80 has a slot 81, and a throughbore 82 transversely positioned with respect to the slot 81. Arms 72' each have a tongue 83 with an eyelet (not shown) that is received in a corresponding one of the slots 81. A pin 84 is threaded through the throughbore 82 and the eyelet of the tongue 83 to lock the arms 72' to the respective tabs 80. The sleeves 73 may be used to connect accessories other than the wind deflector to the handrails 20 of the watercraft. For instance, four of the sleeves 73 could be used to connect a watersport tower to the handrails 20.

It is within the ambit of the present invention to cover any obvious modifications of the preferred embodiment described herein, provided such modifications fall within the scope of the appended claims.

I claim:

1. A watercraft comprising:

a deck;

at least a first connector attached to the deck; and a first handrail connected to the first connector, the first connector being adapted to also connect a first watercraft accessory thereto, the first connector having a support surface adapted to connect the first watercraft accessory, the support surface having a fastener receiving portion.

2. The watercraft according to claim 1, further comprising:

a passenger receiving area;

the first handrail being positioned on a first side of the passenger receiving area;

at least a second connector attached to the deck; and a second handrail connected to the second connector and being positioned on a second side of the passenger receiving area;

the second connector being adapted to also connect one of the first watercraft accessory, and a second watercraft accessory.

3. The watercraft according to claim 2, further comprising a wind deflector having a first end connected to the first handrail and a second end connected to the second handrail.

4. The watercraft according to claim 1, further comprising a sleeve disposed around the first handrail, the sleeve having a connector end adapted to connect to a second watercraft accessory.

5. The watercraft according to claim 1, wherein the first connector is adapted to connect the first watercraft accessory by having a slot, the slot having a fastener receiving portion therein.

6. The watercraft according to claim 5, further comprising a removable cap for placement in the slot so as to conceal the slot when the slot is not used.

7. The watercraft according to claim 1, further comprising the first watercraft accessory connected to the first connector, wherein the watercraft accessory is one of a top structure and a watersport tower.

8. The watercraft according to claim 1, wherein the first handrail and the first connector are integrally formed.

9. A connector for connecting a handrail to a watercraft, comprising:

a connection surface for being secured to a surface of the watercraft;

a handrail connector portion for receiving an end of the handrail to connect the handrail to the watercraft; and a first connector portion for receiving a watercraft accessory to connect the watercraft accessory to the watercraft, the first connector portion being a support surface in the connector, the support surface having a fastener receiving portion.

10. The connector according to claim 9, wherein the first connector portion is a slot in the connector, the slot having a fastener receiving portion therein.

11. The connector according to claim 10, further comprising a removable cap for placement in the slot so as to conceal the slot when the slot is not used.

12. The connector according to claim 9, further comprising a removable cap connectable to the support surface so as to conceal the support surface when the support surface is not used.

13. The connector according to claim 9, further comprising a resilient member on the connection surface for reducing vibrations between the watercraft and the watercraft accessory.

14. A kit for connecting a watercraft accessory to a watercraft, comprising:

a handrail;

two connectors each adapted to be secured to the watercraft, the connectors each having a handrail connector portion for receiving respective ends of the handrail to connect the handrail to the watercraft; and at least a first connector portion for receiving a watercraft accessory to connect the watercraft accessory to any one of the two connectors, the first connector portion being a support surface in the one of the two connectors, the support surface having a fastener receiving portion.

15. The kit according to claim 14, further comprising a sleeve having a connector end, the sleeve being positioned around the handrail.

16. The kit according to claim 14, wherein the handrail and at least one of the two connectors are integrally formed.

* * * * *